US005938506A

United States Patent [19]

Fruitman et al.

[11] Patent Number: 5,938,506

[45] Date of Patent: Aug. 17, 1999

[54] METHODS AND APPARATUS FOR CONDITIONING GRINDING STONES

[75] Inventors: Clinton Fruitman, Chandler; Philbin Scott, Phoenix, both of Ariz.; Joseph Cesna, Niles, Ill.

[73] Assignee: SpeedFam-IPEC Corporation, Chandler, Ariz.

[21] Appl. No.: 08/868,110

[22] Filed: Jun. 3, 1997

[51] Int. Cl.[6] ..... B24B 1/00

[52] U.S. Cl. ..... 451/41; 451/269; 451/287

[58] Field of Search ..... 451/56, 443, 444, 451/548, 159, 173, 285, 287, 288, 289, 291, 269, 413, 72, 533, 527

[56] References Cited

U.S. PATENT DOCUMENTS

| | | | |
|---|---|---|---|
| Re. 23,937 | 2/1955 | Bullard | 451/443 |
| 2,668,397 | 2/1954 | Holzrichter et al. | 451/291 |
| 2,688,215 | 2/1954 | Caspers . | |
| 2,709,321 | 5/1955 | Indge | 451/291 |
| 2,740,237 | 4/1956 | Day et al. | 451/291 |
| 2,973,605 | 3/1961 | Carman et al. | 451/291 |
| 3,110,988 | 11/1963 | Boettcher . | |
| 3,662,498 | 5/1972 | Caspers . | |
| 3,894,673 | 7/1975 | Lowder et al. . | |
| 4,018,576 | 4/1977 | Lowder et al. . | |
| 4,315,383 | 2/1982 | Day | 451/291 |
| 4,593,495 | 6/1986 | Kawakami et al. | 451/291 |
| 4,720,938 | 1/1988 | Gosis . | |
| 4,805,348 | 2/1989 | Arai et al. . | |
| 5,085,009 | 2/1992 | Kinumura et al. | 451/291 |
| 5,099,614 | 3/1992 | Arai et al. . | |
| 5,172,681 | 12/1992 | Ruark et al. . | |
| 5,174,067 | 12/1992 | Hasegawa et al. | 451/291 |
| 5,329,732 | 7/1994 | Karlsrud et al. . | |
| 5,456,627 | 10/1995 | Jackson et al. | 451/56 |
| 5,486,131 | 1/1996 | Cesna et al. | 451/56 |
| 5,498,196 | 3/1996 | Karlsrud et al. . | |
| 5,498,199 | 3/1996 | Karlsrud et al. . | |
| 5,531,635 | 7/1996 | Mogi et al. . | |
| 5,538,460 | 7/1996 | Onodera . | |
| 5,569,062 | 10/1996 | Karlsrud . | |
| 5,591,065 | 1/1997 | Mizuno et al. . | |
| 5,643,067 | 7/1997 | Katsuoka et al. . | |

FOREIGN PATENT DOCUMENTS

| | | | |
|---|---|---|---|
| 1126998 | 12/1956 | France . | |
| 402065967 | 3/1990 | Japan | 451/288 |
| 1462510 | 6/1974 | United Kingdom . | |

OTHER PUBLICATIONS

Bulletin for Abrasive Technology, Inc. entitled "Technical Bulletin P.B.S.® vs. Electroplating", undated.

U.K. Patent Application No. 28879/74, Filed Jun. 28, 1974, entitled "Method of Making Abrasive Tools".

*Primary Examiner*—David A. Scherbel
*Assistant Examiner*—Derris Holt Banks
*Attorney, Agent, or Firm*—Snell & Wimer, LLP

[57] ABSTRACT

The present invention relates generally to a method for conditioning polishing materials that are generally used to polish disks used for magnetic recording. The polishing material is conditioned by moving a conditioning ring relative to the polishing material. More particularly, the conditioning ring is rotated and/or orbited across the surface of the polishing material, so that the material is conditioned. Preferably, the conditioning ring comprises an annular ring of abrasive material fixedly applied to a substantially planar surface of the conditioning ring.

20 Claims, 3 Drawing Sheets

FIG. 3
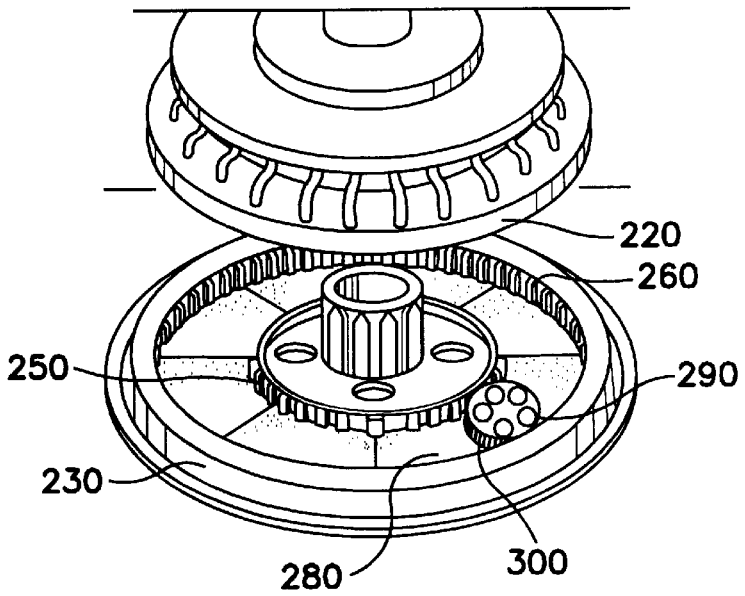
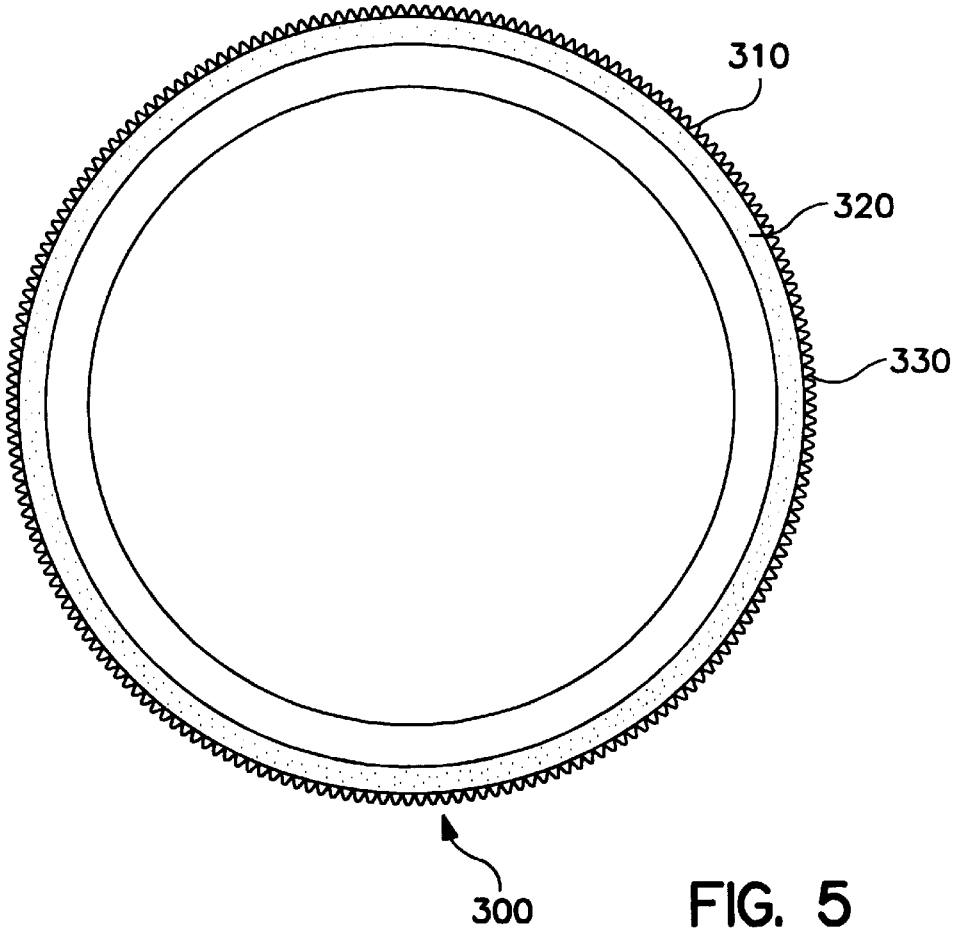
FIG. 5

METHODS AND APPARATUS FOR CONDITIONING GRINDING STONES

TECHNICAL FIELD

The present invention relates, generally, to methods and apparatus for the planarization and fine finishing of flat surfaces of workpieces, and, more particularly, to a method and apparatus for conditioning flat grinding, honing, lapping, and polishing materials used for the finishing of the workpieces.

BACKGROUND ART AND TECHNICAL PROBLEMS

The production of workpieces (e.g, disks) used in the magnetic disk drive industry begins with the creation of a substrate with a hard smooth surface upon which magnetic material is deposited. Fabrication of a magnetic disk typically involves lapping or honing a disk substrate, such as, aluminum, to a high degree of flatness with as smooth a finish as is possible. With some substrates, such as aluminum, intermediate layers of hardeners such as amorphous NiP coatings are applied. The substrate disks are then polished to a much higher degree of smoothness. Magnetic media is then typically sputtered onto the substrate surface, buffed to remove micro-asperities, and toughened with hard coatings and lubricants.

A disk drive operates by passing a read-write head over the surface of the disk. Because the read-write head passes over the disk in very close proximity, it is important for the disk to have a very flat, smooth, or controlled micro-roughened surface. If the surface of the disk is overly rough or uneven, the read-write head may touch the disk or "crash," causing permanent damage to the disk drive and resulting in a loss of data. As disk drives evolve with greater memory capacities, read write heads fly closer to the memory disks. Thus, defects and minute waves on the disks are becoming an even bigger problem with memory disk evolution.

Lapping, honing, and polishing workpieces or disks coated with hard material is well known in the art. These processes generally include placing the workpiece in a carrier, placing the carrier and workpiece between two platens, each having the appropriate abrasive composition or surface attached thereto, and moving the carrier (and hence the workpieces) relative to the abrasive surface.

Abrasive surfaces can be formed of various materials, as is known in the art, and which are available commercially. Typically, the lapping or honing surface is formed from a resin bonded silicon carbide grinding stone, for example, a stone manufactured by Kanebo oe Nitokken of Japan. The removal rate and variability of the stock removal across the surface of the workpiece depends on several factors, including the composition and condition of the abrasive surface.

During these processes, the micro-structures of these abrasive surfaces wear and are eventually crushed from the load on the surfaces, causing them to become less effective. Accordingly, to increase the effectiveness and life of these surfaces, it is desirable to condition the worn surfaces, for example, by removing a portion of the surface material and any excess debris that may reside on them, thus exposing a fresh abrasive surface.

Referring now to FIG. 1, one well known method for conditioning the lapping, honing, or polishing surface is to roughen the surface with one or more conditioning plates or carriers 10 which include pellets 20 having abrasive particles (not shown) attached thereto. In accordance with this well known method, pellets 20 are typically cylindrically shaped and are attached to one surface of carrier 10, by, for example, brazing or glueing the pellets to one surface of carrier 10.

Generally, an upper and a lower abrasive platen surface, are conditioned on a machine at the same time by placing conditioning carriers 10 between the upper and lower abrasive surfaces. The conditioning of the polishing surfaces proceeds by placing a number of the conditioning carriers 10 with their abrasive side down to condition the lower polishing surface and placing an equal number of conditioning carriers 10 with the abrasive side up to condition the upper polishing surface. The upper platen surface functions as a reference plane for the conditioning carriers 10 with the abrasive side toward the lower platen surface, and the lower platen surface functions as a reference plane for the conditioning carriers 10 with the abrasive side toward the upper platen surface.

This well known conditioning process has several shortcomings, particularly on softer abrasive platen materials such as honing stones and polish pads. For example, during the conditioning process, the individual pellets 20 typically exert localized pressures on the abrasive surface, thereby deforming the surface by creating multiple moving indentations therein. In addition, these indentation tracks caused by pellets 20 typically overlap; however, because of the elastic behavior of the materials being dressed, such as honing stones, polish pads, and the like, the stones and pads typically recover in the areas between the pellets (i.e., in the areas where tracks do not overlap). Thus, the overlapping wear of the pellets form "waves" on the surface of the honing or polishing materials which, in turn, create a micro-waviness on the workpiece surfaces. Moreover, because of the geometric configuration of the conditioning carrier 10 of FIG. 1, (i.e., pellets covering a substantial portion of the carrier) the wear caused by the pellets on the outside diameter of the carrier is not uniform with the wear caused by the inside pellets. In other words, as the carrier 10 rotates and orbits about the abrasive loaded platens, the inside pellets cover a lesser area of the stone or polish pad.

Accordingly, new methods and apparatus for conditioning the surface of a polishing material are therefore needed that overcome the limitations of the prior art.

SUMMARY OF THE INVENTION

The present invention provides methods and apparatus for conditioning the surface of a flat abrasive material that overcomes many of the shortcomings of the prior art.

In accordance with one aspect of the present invention, an abrasive material, such as a honing stone or a polish pad is conditioned with a conditioning apparatus which has two substantially planar surfaces with a continuous ring of abrasive material mounted to at least one surface of the apparatus. Because the carrier has a continuous ring of abrasive materials rather than several pellets of abrasive material, fewer leading and trailing edges of abrasive material are present. Thus, the multiple indentations and wear tracks in honing stones and polish pads are reduced if not eliminated. Further, the conditioning apparatus with an annular ring of abrasive material removes material and debris from the abrasive pads or stones at a substantially uniform rate across the entire surface.

In accordance with another aspect of the present invention, the conditioning apparatus rotates about a vertical axis which is substantially perpendicular to the plane of the polishing material.

In accordance with yet another aspect of the present invention, the conditioning apparatus orbits in a circular direction around the polishing material.

In accordance with yet another embodiment of the present invention, the stone or pad material rotates about a vertical axis.

In accordance with yet another embodiment of the present invention, the continuous ring of abrasive material is formed by braze bonding, gluing, or direct deposition of the abrasive materials to an annular flange on the conditioning ring.

BRIEF DESCRIPTION OF THE DRAWINGS

The present invention will hereinafter be described in conjunction with the appended drawing figures, wherein like numerals denote like elements, and:

FIG. 3 is a perspective elevation view of the top portion of the polishing apparatus of FIG. 2;

FIG. 5 is a plan view of a conditioning ring.

DETAILED DESCRIPTION OF A PREFERRED EXEMPLARY EMBODIMENT

The present invention relates to an improved process for conditioning polishing materials. While this invention may be used to condition a large variety of lapping, honing, and polishing materials which may be used to surface finish a variety of different types of workpieces, the preferred exemplary embodiments discussed herein relate to a conditioning apparatus for conditioning honing stones, which are typically used to lap and polish workpieces such as nickel-coated aluminum disks. It will be understood, however, that the invention is not limited to any particular abrasive material conditioning environment.

Figure 1:
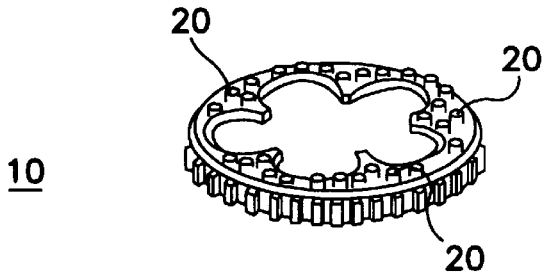
FIG. 1 is a perspective view of a conditioning ring currently known in the art.
Figure 2:
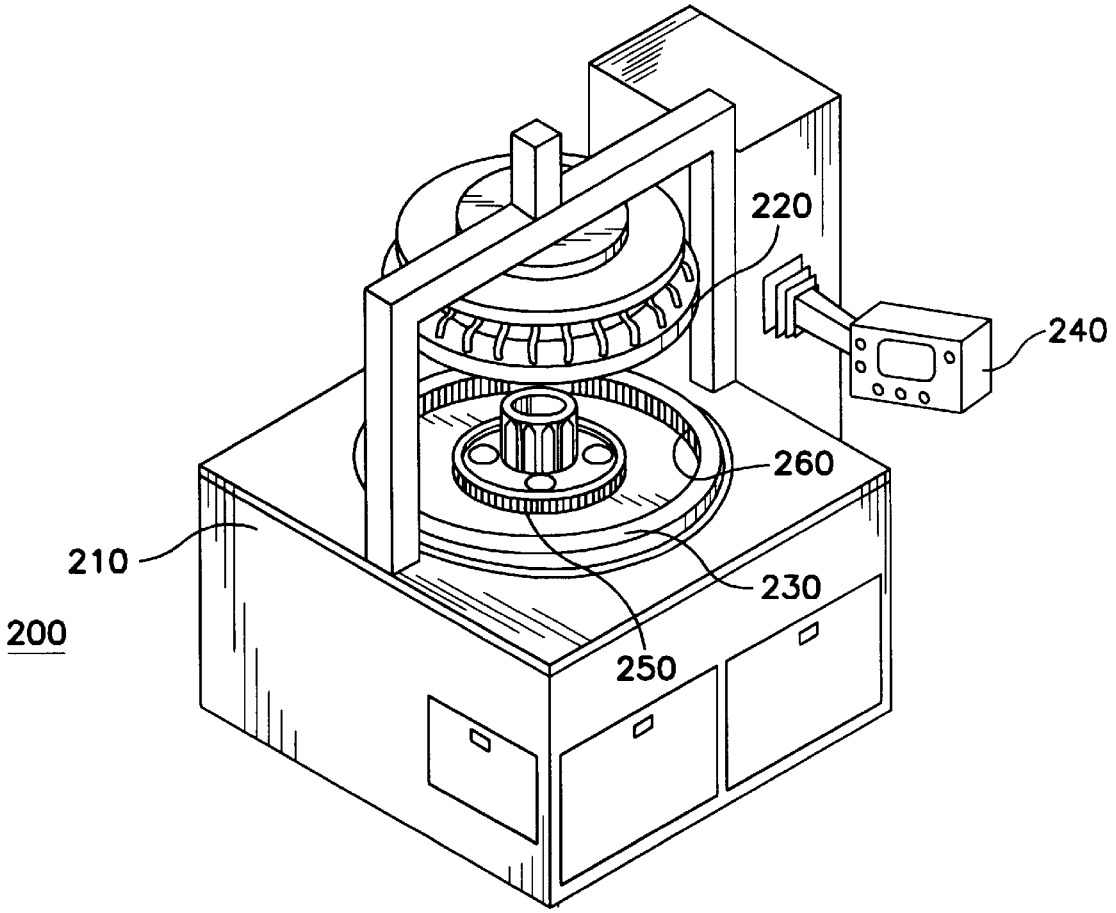
FIG. 2 is a perspective elevation view of a polishing apparatus with which the present invention may operate.

Referring now to FIGS. 2 and 3, a typical double sided honing machine 200 is shown. Honing machine 200 is configured to remove material from, and/or polish the surface of, a workpiece (not shown), for example, aluminum disks, nickel-coated aluminum disks, and the like. In accordance with a preferred embodiment, machine 200 suitably comprises a base 210, an upper platen 220, a lower platen 230, and a control panel 240 that is used to program and control the polishing machine. Lower platen 230 suitably comprises a sun gear 250 and a ring gear 260. Each platen 220, 230 preferably includes a polishing material 280 (see FIG. 3) fixedly attached to at least one surface.

Referring now to FIG. 3, to hone workpieces, the workpieces typically are placed in one or more workpiece carriers 290 which are then placed between upper platen 220 and lower platen 230. During the honing process, upper platen 220 is lowered onto workpiece carriers 290, thus sandwiching the carriers 290 between upper platen 220 and lower platen 230, so that the honing stone materials on upper platen 220 and lower platen 230 contact the workpieces in the carriers 290. Honing of the workpieces occurs when upper platen 220, lower platen 230, and the workpieces are moved relative to each other. Typically, a coolant such as deionized water mixed with surfactants and lubricants (not shown) is present during the honing process to help remove debris from the surfaces of the workpieces and the polishing material, and to keep the workpieces cool during the honing process.

Figure 4:
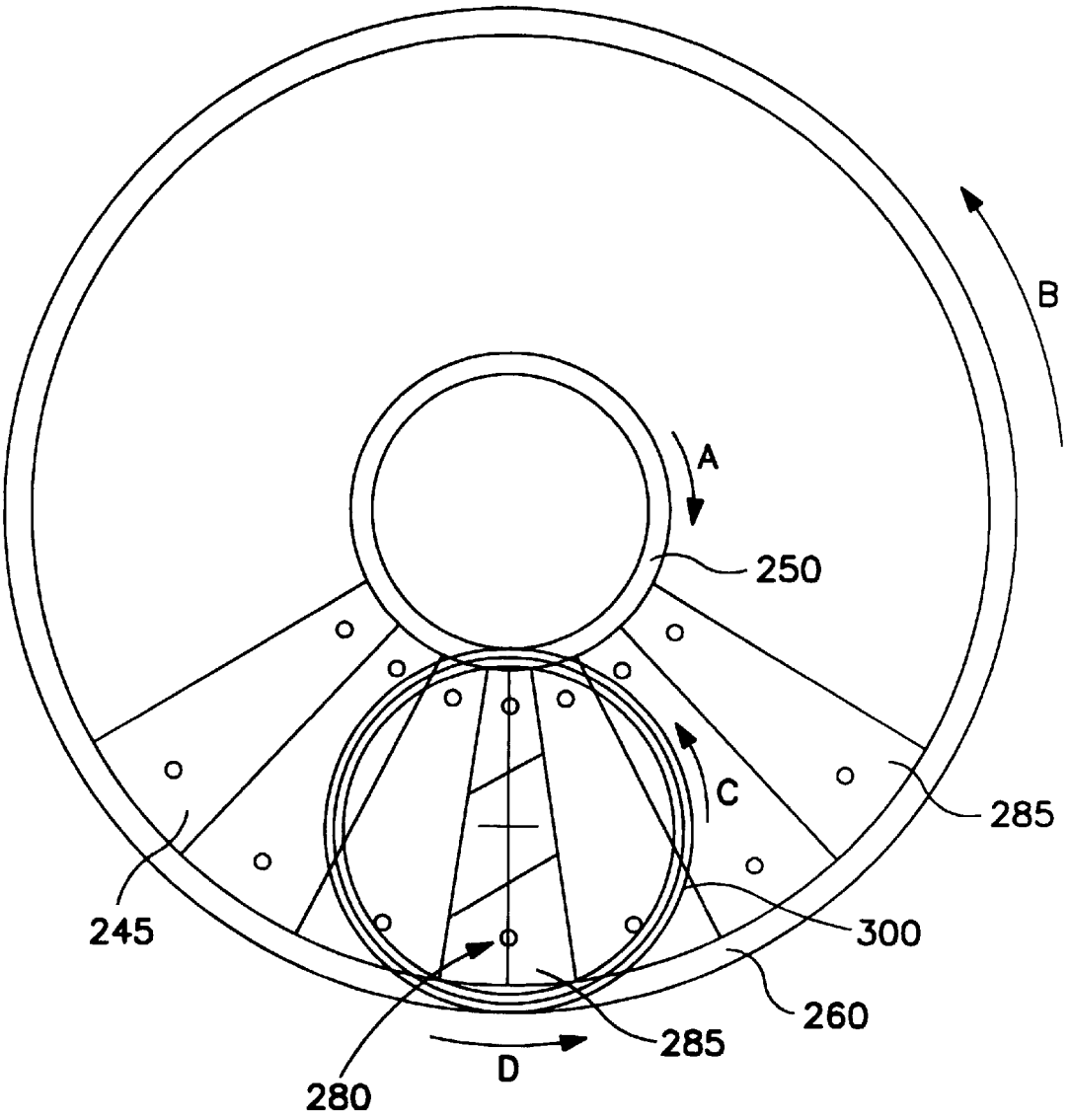
FIG. 4 is a plan view of a platen with a plurality of abrasive grinding stones attached thereto and a carrier in contact with the grinding stones.

Referring now to FIGS. 3 and 4, platens 220, 230 each have abrasive material 280 attached thereto. Abrasive material 280 typically comprises a plurality of generally pie-shaped abrasive stone segments 285. It should be noted, however, that any particular surface grinding or honing stone may be used as the polishing material; for example, the stone may be a one-piece honing stone.

Referring again to FIG. 4, each stone segment is fixedly mounted to platens 220, 230 so that abrasive material 280 is secured thereon, preventing them from moving when normal operating stresses occur. For optimum honing or wear of each workpiece, it is desirable that the stone flatness be as uniform as possible across the entire surface of each segment 285 and across all of the segments. Also, it is typically desirable to remove the worn top layer(s) of the abrasive surface so that a new, more abrasive layer is exposed. The surface of the stone segments 285 and, accordingly, the entire abrasive surface 280 is planarized or made uniform by conditioning the segments with an exemplary conditioning apparatus.

Referring now to FIGS. 4 and 5, a conditioning apparatus and its operation will now be discussed. Abrasive material 280 is suitably conditioned by moving a conditioning ring 300 into contact with and relative to the polishing material. In particular, conditioning ring 300 is configured to rotate and/or orbit across abrasive material 280 so that the abrasive portion of ring 300 removes a portion of the polishing material in addition to debris that may be present on the polishing material.

With continued reference to FIGS. 3–5, an even number of conditioning rings 300 are rotated about their respective center axes and orbited about a center axis of platens 220, 230 by sun gear 250 and ring gear 260. In particular, a plurality of gear teeth 310 located on the outer edge of ring 300 are configured to mate with sun gear 250 and ring gear 260, which, in turn, drive the conditioning rings. Specifically, sun gear 250 suitably rotates in a direction indicated by arrow A, and ring gear 260 rotates in the opposite direction indicated by arrow B. One skilled in the art will appreciate that when ring gear 260, sun gear 250, or a combination thereof rotate, conditioning ring 300 will suitably rotate in the direction as indicated by arrow C. Further, conditioning ring 300 may orbit around polishing material 280. That is, if ring gear 260 and sun gear 250 rotate at different speeds, i.e., different radians per minute, conditioning ring(s) 300 will rotate in the direction of the faster traveling gear. Specifically, if gear 260 is rotating at a faster rate than gear 250, conditioning ring(s) 300 will orbit in the direction indicated by arrow D. Similarly, if gear 260 is rotating at a faster rate than gear 250, the conditioning ring(s) 300 will orbit in a direction opposite arrow D. If the gears are rotating at the same rate, the conditioning ring 300 will rotate, but it will not orbit about polishing surface 230. The direction of arrows A–D are shown for illustration purposes only. One skilled in the art will appreciate that gears 250, 260 may rotate in the opposite directions. As mentioned previously, the rate and direction of those rotations will dictate the rotation and orbit direction of conditioning ring(s) 300.

In accordance with a preferred conditioning recipe, conditioning ring(s) 300 are initially placed face down and orbit around the polishing material 280 at a rate of about two (2) to eight (8) orbits per minute and more preferably about five (5) orbits per minute in a counterclockwise direction. In addition, conditioning rings 300 rotate about their axes in a counterclockwise direction at about fifteen (15) to about twenty-five (25) RPM and preferably at about twenty (20)

RPM. In accordance with this aspect of the invention, the polishing material 280 on lower platen 230 may be conditioned by placing the conditioning rings 300 on the surface of polishing material 280 without any pressure from the upper platen 220, or the upper platen 220 may be lowered onto the conditioning rings 300 to add additional pressure to the rings 300 during conditioning. In any event, the lower platen 230 with polishing material 280 is typically moved in the counterclockwise direction. This step dresses a reference plane on polishing material 280.

After conditioning polishing material 280 on lower platen 230, two opposite rings are then flipped face up. The upper platen 220 is lowered and the process is repeated with upper platen 220 rotating in a clockwise direction, and lower platen 230 rotating in a counterclockwise direction, both at a rate of about 10 to about 40 RPM. The reference plane of the lower platen 230 enables the faced-up carriers to dress the upper platens 220 with the same shape.

Because the inside diameter of the abrasive platens contact the conditioning rings 300 at a different velocity than the outside diameter of the abrasive platens, speeds and rotational directions of both conditioning rings 300 and platens are adjusted to achieve the desired shape of the matched platens. Specifically, the applied force of platens 220 and 230 on the conditioning rings 300, the orbital speed of rings 300, and the rotational speeds of polishing material 280, sun gear 250, and ring gear 260 can be adjusted to maximize the efficiency and effectiveness of the conditioning process. In addition, a liquid coolant, for example deionized water with surfactants and lubricants, is typically present during the conditioning process. The coolant flushes debris and keeps the surface of the abrasive material at a desired temperature during dressing, which helps maintain the desired conditioning uniformity.

Still referring to FIGS. 4 and 5, a more detailed view of conditioning ring 300 is shown. As is well known in the art, conditioning ring 300 may be made from a variety of different rigid materials, including various different metal, plastic and ceramic materials. In accordance with a preferred embodiment of the present invention, conditioning ring 300 is made from stainless steel and includes an annular flange 320 at its outer diameter having abrasive material 330 attached to the exposed surface of the flange 320. This continuous ring of abrasive particles reduces, if not eliminates, the problems with the prior art (i.e., scratches and waves on the polishing surface) because the numerous leading and trailing edges are eliminated.

In a preferred embodiment of the invention, abrasive material 330 may be any hard cutting material useful for conditioning the polishing material, such as for example, diamond particles, polycrystaline chips, crystalline chips, and the like. Further, the abrasive particles may be secured to a surface of the conditioning ring 300 by a number of methods. In accordance with a preferred embodiment of the invention, the annular ring of abrasive particles may be glued to a surface of the conditioning ring 300, or the abrasives may be braze bonded or plated to the surface. More detailed discussion of braze bonding cutting or conditioning elements to conditioning rings are set forth in U.S. patent application Ser. No. 08/683,571, filed Jul. 15, 1996, and entitled "Device for Conditioning Polish Pads Utilizing Brazed Diamond Technology" and U.S. patent application Ser. No. 08/704,088, filed Aug. 28, 1996, and entitled "Device for Conditioning Polish Pads Utilizing Brazed Cubic Boron Nitride Technology," both of which are incorporated herein by reference.

In accordance with one embodiment of the invention, the abrasive material is about 0.25 to about 2 inches and preferably about 0.54 inches.

In a further preferred embodiment, as illustrated in FIG. 4, whenever the machine design allows, the inside diameter of the flange of abrasive material is larger than the width of abrasive segment 280. Accordingly, a portion of the continuous annular ring of abrasive particles does not contact the polishing material during conditioning. This allows the platen segment to be swept with a linear element which tends to be less sensitive to bumps and waves on the platen. Thus, by straddling the platen segment, the ring element seats into a plane and cuts a nearly planar path.

It should be understood that the foregoing description is of preferred exemplary embodiments of the invention and that the invention is not limited to the specific forms shown or described herein. Various modifications may be made in the design, arrangement, and type of elements disclosed herein, as well as the steps of using the invention without departing from the scope of the invention as expressed in the appended claims.

We claim:

1. An apparatus for conditioning a surface of an abrasive material mounted to a first platen on a honing machine configured for honing disk surfaces, said apparatus comprising:

a rigid conditioning ring comprising a first planar surface, a second planar surface, and an outer edge;

gear teeth on said outer edge of said conditioning ring; and an annular ring of abrasive particles attached at an outer diameter of at least one of said first and said second planar surfaces of said conditioning ring, said annular ring having an inside diameter which is greater than a width of said abrasive material surface, such that a portion of said annular ring does not contact said abrasive material surface during conditioning; and wherein said gear teeth on said conditioning ring are configured to mate with a first drive gear and a second drive gear on said honing machine, so that said first and said second drive gears cause said conditioning ring to rotate on and orbit about the surface of said abrasive material, thus conditioning said abrasive material.

2. The apparatus of claim 1, further comprising a flange at the outer diameter of at least one of said first and said second planar surfaces of said conditioning ring, wherein said abrasive particles are attached to a surface of said flange.

3. The apparatus of claim 1, wherein said abrasive particles comprise diamond particles.

4. The apparatus of claim 1, wherein said abrasive particles comprise cubic boron nitride particles.

5. The apparatus of claim 1, wherein the rotation rate of said conditioning ring on said abrasive material is responsive to the rotation rates of said first and said second drive gears.

6. The apparatus of claim 1, wherein the orbit rate of said conditioning ring about said abrasive material is responsive to the rotation rates of said first and said second drive gears.

7. The apparatus of claim 1, and further comprising a second platen which presses said conditioning ring against said first platen to enhance the conditioning of the surface of said abrasive material on said first platen.

8. The apparatus of claim 1, wherein said first platen is rotated at variable speeds to enhance the conditioning of the surface of said abrasive material on said first platen.

9. The apparatus of claim 1, wherein the rotation of said first platen is reversible.

10. The apparatus of claim 1, wherein the rotation and orbit of said conditioning ring is reversible.

11. An apparatus for conditioning a honing stone of a honing platen mounted on a machine for honing disk surfaces, wherein said honing machine further comprises a first drive gear and a second drive gear, said apparatus comprising:

a rigid conditioning ring comprising a first planar surface, a second planar surface, and an outer edge;

gear teeth on said outer edge of said conditioning ring; and a flange located at an outer diameter of at least one of said first and said second planar surfaces of said conditioning ring, said flange comprising a plurality of abrasive particles attached thereto, and said flange having an inside diameter which is greater than a width of said honing stone located between said first and second drive gears, such that a portion of said flange does not contact said honing stone during conditioning; and wherein said gear teeth on said conditioning ring are configured to mate with said first drive gear and said second drive gear on said honing machine, so that said first and said second drive gears cause said conditioning ring to rotate on and orbit about the surface of said honing stone, thus conditioning said stone.

12. The apparatus of claim 11, wherein said abrasive particles comprise diamond particles.

13. The apparatus of claim 11, wherein said abrasive particles comprise cubic boron nitride particles.

14. The apparatus of claim 11, wherein the rotation rate of said conditioning ring on said honing platen is responsive to the rotation rates of said first and said second drive gears.

15. The apparatus of claim 11, wherein the orbit rate of said conditioning ring about said honing platen is responsive to the rotation rates of said first and said second drive gears.

16. A method for conditioning a surface of an abrasive material mounted on a platen of a honing machine configured for honing disk surfaces, comprising the steps of:

placing at least one conditioning ring, comprising an annular ring of abrasive particles attached to a surface of said conditioning ring, on the surface of said abrasive material, so that said abrasive particles contact the surface of said abrasive material on said platen, and so that said annular ring has an inside diameter which is greater than a width of said abrasive material, such that a portion of said annular ring does not contact said abrasive material during conditioning, and causing said conditioning ring to rotate on said orbit about the surface of said abrasive material, so that said conditioning ring conditions the surface of said abrasive material on said platen.

17. The method of claim 16, wherein said honing machine comprises an upper platen of abrasive material and a lower platen of abrasive material, and wherein said method further comprises the step of applying force to said conditioning ring by moving said upper platen into contact with said conditioning ring, said force aiding in the conditioning of the abrasive material on said platen.

18. A method for conditioning abrasive surfaces of a honing material mounted on a lower platen and an upper platen of a honing machine configured for honing disk surfaces, comprising the steps of:

providing at least one conditioning ring, comprising gear teeth on an outer edge of said conditioning ring and an annular ring of abrasive particles on at least one surface of said conditioning;

placing said conditioning ring on said lower platen, so that said abrasive particles on said conditioning ring contact said abrasive surface of said honing material on said lower platen, and so that said gear teeth mate with a first drive gear and a second drive gear on said honing machine, and so that said annular ring has an inside diameter which is greater than a width of said abrasive material located between said first and second drive gears, such that a portion of said annular ring does not contact said abrasive material during conditioning;

conditioning the abrasive surface of said honing material on said lower platen by rotating said conditioning ring on and orbiting said conditioning ring about the abrasive surface of said honing material on said lower platen;

flipping said conditioning ring over, so that said abrasive particles on said conditioning ring will contact the abrasive surface of said honing material on said upper platen when said upper platen is lowered onto said conditioning ring; and conditioning the abrasive surface of said honing material on said upper platen by lowering said upper platen onto said conditioning ring and rotating said conditioning ring on and orbiting said conditioning ring about the abrasive surface of said honing material on said upper platen.

19. The method of claim 18, wherein the rotation rate of said conditioning ring on and the orbit rate of said conditioning ring about the abrasive surface of said honing materials is responsive to the rotation rates of said first and said second drive gears.

20. The method of claim 18, wherein said step of conditioning the abrasive surface of said honing material on said lower platen further comprises the step of lowering said upper platen onto said conditioning ring, so that pressure is applied to said conditioning ring.

* * * * *